US008433072B2

(12) United States Patent
Müller et al.

(10) Patent No.: US 8,433,072 B2
(45) Date of Patent: Apr. 30, 2013

(54) HEARING INSTRUMENT USING RECEIVERS WITH DIFFERENT PERFORMANCE CHARACTERISTICS

(75) Inventors: Christian Müller, Berne (CH); Ivan Jørgensen, Smørum (DK); Franz Treue, Smørum (DK); Christian C. Bürger, Smørum (DK)

(73) Assignees: Oticon A/S, Smorum (DK); Bernafon AG, Berne (CH)

( * ) Notice: Subject to any disclaimer, the term of this patent is extended or adjusted under 35 U.S.C. 154(b) by 327 days.

(21) Appl. No.: 12/743,211

(22) PCT Filed: Nov. 7, 2008

(86) PCT No.: PCT/EP2008/065139

§ 371 (c)(1),
(2), (4) Date: May 14, 2010

(87) PCT Pub. No.: WO2009/065742

PCT Pub. Date: May 28, 2009

(65) Prior Publication Data

US 2010/0272272 A1 Oct. 28, 2010

(30) Foreign Application Priority Data

Nov. 19, 2007 (EP) ..... 07121029

(51) Int. Cl.
*H04R 29/00* (2006.01)
*H04R 25/00* (2006.01)

(52) U.S. Cl.
USPC ..... 381/60; 381/312

(58) Field of Classification Search ..... 381/58, 381/60, 312–315
See application file for complete search history.

(56) References Cited

U.S. PATENT DOCUMENTS

| | | | | |
|---|---|---|---|---|
| 5,659,621 | A | 8/1997 | Newton | |
| 6,269,318 | B1 | 7/2001 | Geddes | |
| 6,712,754 | B2 | 3/2004 | Miller et al. | |
| 6,859,538 | B1 | 2/2005 | Voltz | |
| 6,934,400 | B1 | 8/2005 | Vonlanthen | |
| 7,064,957 | B1 | 6/2006 | Liang et al. | |
| 7,286,678 | B1 | 10/2007 | Bachler et al. | |
| 8,027,496 | B2 | 9/2011 | Bachler et al. | |
| 2002/0015506 | A1 | 2/2002 | Aceti et al. | |
| 2002/0026091 | A1 | 2/2002 | Leysieffer | |
| 2003/0086582 | A1 | 5/2003 | Vonlanthen | |
| 2007/0019817 | A1 | 1/2007 | Siltmann | |
| 2007/0286441 | A1 | 12/2007 | Harsch et al. | |
| 2008/0008340 | A1 | 1/2008 | Bachler et al. | |
| 2009/0028364 | A1 * | 1/2009 | Vonlanthen | 381/312 |

FOREIGN PATENT DOCUMENTS

| | | | |
|---|---|---|---|
| EP | 1 701 585 | A2 | 9/2006 |
| WO | WO 99/09799 | A2 | 3/1999 |
| WO | WO 02/11509 | A1 | 2/2002 |
| WO | WO 2006/071210 | A1 | 7/2006 |
| WO | WO 2007/045254 | A1 | 4/2007 |
| WO | WO 2009/006889 | A1 | 1/2009 |

* cited by examiner

*Primary Examiner* — Tuan D Nguyen
(74) *Attorney, Agent, or Firm* — Birch, Stewart, Kolasch & Birch, LLP

(57) ABSTRACT

The invention regards a hearing aid comprising a receiver and a signal processing device, wherein the signal processing device is electrically coupled to a connection socket operable to detachably connect the receiver to the socket and whereby the signal processing device further comprise a detector operable to detect a characteristics of the receiver which is connected to the signal processing device through the connection socket. The present invention addresses the problem of identification of individual receiver properties as well as of identifying different types of receivers.

16 Claims, 14 Drawing Sheets

HEARING INSTRUMENT USING RECEIVERS WITH DIFFERENT PERFORMANCE CHARACTERISTICS

AREA OF INVENTION

The invention relates to a hearing aid, to a signal processing device for the use in such hearing aid and to the adaptation of such hearing aid to the needs of a hearing impaired person using such hearing aid.

BACKGROUND OF THE INVENTION

The common hearing aid of today is a digitally programmable hearing aid comprising a microphone, a signal processing device and a receiver. The hearing aids are sold with only one predetermined type of receiver. Adaptation of the hearing aid to the needs of the hearing impaired is performed by programming the signal processing device of the hearing aid. For the adaptation, the hearing loss can be categorized in different levels of severity. Different levels of severity require different degrees of the output sound pressure level of the receiver. During programming of the hearing aid the degree of amplification in the signal processing device is set to provide a certain degree of output sound pressure level of the receiver. However, the maximum output sound pressure level is a property of the receiver that is built into the hearing aid. To be able to use the hearing aid for any level of severity of the hearing loss, a receiver with a very high maximum output sound pressure level has to be used. The use of a receiver with a lower maximum output sound pressure level would be less expensive. Furthermore, different dynamic ranges are preferable for different degrees of severity of the hearing loss, also with regards to the quality of adaptation of the hearing aid to the needs of the hearing impaired user. Accordingly, the use of only one predetermined receiver has the drawback that the hearing aid can not be adapted to a wide variety of severity of the hearing loss with a maintained level of quality.

From US 2002/0026091 A1 and from U.S. Pat. No. 6,712,754 B2 implantable hearing systems comprising a transducer for communicating vibrations to the ossicular chain are known. The described hearing aids comprise impedance measuring means for measuring the mechanical impedance of a biological load structure which, upon implantation of the output transducer, is coupled to the output transducer. The measured impedance is not a characteristic parameter of the transducer itself.

From U.S. Pat. No. 6,934,400 B1 a hearing aid comprising a signal processing unit and an electric/mechanical transducer is known wherein the impedance of the transducer can be switched to different levels to adapt the dynamic range of the hearing aid to different situations. However, the described hearing aid has the drawback that the structure of the transducer is rather complicated, needs much space and is expensive.

In recent years a the type of hearing aids have become increasingly popular, namely where the receiver part of the hearing aid is placed in the ear canal and the remaining hearing aid parts are placed in a housing behind the ear lobe of the hearing aid user. In this type of hearing aid the receiver may easily be exchanged, and here it is important that the receiver which is used is in line with the settings or contents of the behind the ear part of the hearing aid.

As the market for Receiver in the Ear (RITE) hearing aids (HA's) increases, more RITE modules with different receivers will come to co-exist in the coming years. A strategy for identifying and distinguishing these RITE modules is needed to ensure that future HA solutions will not impose damage and/or produce uncomfortable sound levels to the end user in case of attaching a wrong RITE module, e.g. one with higher sensitivity than expected during fitting.

WO 02/11509 describes a hearing device comprising a first module with an electrical supply as well as an electrical to mechanic output converter and a second module with a signal processing unit as well as an acoustical/electrical input converter. In an embodiment, the hearing device comprises a code unit in said first module and a code-reader and decoding unit in said second module. WO 99/09799 deals with a hearing aid with a central signal processing unit, which interacts with peripheral units on the input and output side. The peripheral units each have an identification unit whose output interacts with the input of a comparing unit. The comparing unit in turn interacts with identification-possibility memory units, and acts on a configuration storage unit on the output side. In this way, the hearing aid configuration can identify itself using the peripheral units.

SUMMARY OF THE INVENTION

It is the object of the invention to adapt a hearing aid to the needs of a hearing impaired user of such hearing aid in a safe and reliable manner with low costs. This adaptation includes choosing the right receiver, and/or adapting the hearing aid to the possible variation in receiver properties which might exist between receivers of the same type.

In practice, each receiver has a different physical properties (e.g. frequency response) depending firstly on receiver type (intended technical specifications) and secondly on product variations within a given type. Knowledge of the exact properties (e.g. response) of a given receiver can be used to obtain a more precise amplification (possibly without knowing its type). Knowledge of the properties (e.g. frequency response) of a particular receiver is useful not only in a hearing aid where the receiver is located in a separate body but also in a hearing aid, where the receiver is implemented in the hearing aid-body, e.g. together with a processing unit.

The present invention addresses the problem identification of individual receiver properties as well as of identifying different types of receivers. The term type is used interchangeably with the terms model or version to mean identification of characteristics of a sort of receiver possibly selected among a larger number of individual items, which are intended to have the same properties. A type or model or version of a receiver can e.g. be characterized by its intended technical specifications, such as its input sensitivity and/or max output volume. The terms type or model or version of the receiver is on the other hand not intended to provide a unique identification of the individual receiver (such as its individual detailed frequency response).

According to the invention, a hearing aid comprising a receiver connected to the signal processing device and a microphone connected to the signal processing device is provided which is electrically coupled to a connection socket operable to detachably connect a receiver to the socket and further comprise a detector operable to detect a characteristics of the receiver connected to the signal processing device through the connection socket. Alternatively, the connection socket may have the form of a plug or be a combination of a plug and a socket or any other electrical connector appropriate for electrically connecting two parts of relatively small dimensions (in the mm-range).

The term 'a characteristics of the receiver' is in the present context taken to mean a) a unique identification of an individual receiver (such as its individual frequency response)

and/or b) its type or model or version defining the intended technical specifications (for a larger group of receivers, which are intended to be equal).

Accordingly, a receiver with the optimum dynamic range of the output pressure level for a certain level of severity of hearing loss can be provided without the need of a complicated mechanism within the receiver to adjust the dynamic range and/or maximum output sound pressure. Also, means for detecting the type or the size of the receiver by detecting a characteristic parameter of the receiver provide the possibility to avoid the situation that an output sound pressure level which is too high for the level of severity of the hearing loss is provided after exchange of the receiver. It should be noted that a too high output sound pressure level might damage the hearing of the user, and the means for detecting the type of the receiver provide the possibility to adapt the dynamic range and/or the maximum output sound pressure level of the receiver by controlling the signal processing device such that it is ensured that the users hearing is not damaged.

The signal processing device for use in a hearing aid usually comprises one, two or more input channels adapted to receive microphone or telecoil audio input signals and further has a signal processing scheme, which is programmable such that the particular hearing impairment of the user may be reflected in an amplification scheme which is applied to the input signal. The amplified input signal is then served at the receiver connection socket, and thereby transferred by wire to the receiver. The signal processing device is powered by a battery in the well known manner.

In an embodiment of the invention the detector is operable to detect an impedance of the receiver. The impedance of the receiver is thus the characteristic parameter which may be detected by the signal processing device. This has the advantage that the output sound pressure level of the receiver can be detected because the output sound pressure level is related to the impedance of the receiver. A high impedance of the receiver corresponds to a low output sound pressure level, whereas a low impedance of the receiver corresponds to a high output sound pressure level of the receiver at a predetermined driving signal.

In a further embodiment the signal processing device comprise circuitry operable to provide a wireless or wired call signal to an electronic ID tag, and circuitry operable to receive a wired or wireless reply signal from an electronic ID tag provided in the receiver and a de-coding circuitry operable to decode the signal received from the ID tag The use of an electronic ID tag of the receiver as a characteristic parameter has the advantage that the determination of different types of receivers may relate to any property of the receiver, such as the maximum output pressure level, the dynamic range or the version of a certain type of receiver. Furthermore, the read out of the electronic ID tag does not interfere with the normal operation of the hearing aid. An ID tag, e.g. an RFID tag, may comprise a very small IC with an antenna or electrical connectors, which may be contacted and provide a signal wherein a unique identification coder or other information is embedded.

In an embodiment of the invention the signal processing device is digitally programmable. The use of a digitally programmable signal processing device has the advantage that the signal processing is variable. Accordingly, the flexibility of a digitally programmable signal processing device is extremely high.

The feature, that the signal processing device comprises memory space for accommodation of information gathered on the characteristic parameter of a receiver and where this information is transferable to a programming device coupled to the signal processing device, avoids mistakes which can happen if properties of the receiver would have to be input into the programming device manually. In this way the error proneness can be minimized. Furthermore, the programming of the hearing aid becomes more easy as the programming device already has access to the properties of the receiver provided in connection with the signal processing device when the signal processing device is coupled to the programming device.

Preferably a controller for controlling the detecting means in a way which ensures periodical detection of the characteristic parameter is provided. The possibility to detect an incorrect receiver before the receiver is put into the ear of the hearing impaired user is provided hereby.

Preferably the signal processing device comprises a controller operable to control the detecting means in order to perform a detection of the characteristic parameter during the start-up of the signal processing device. Hereby the possibility to avoid interference with the sound processing during the normal operation of the hearing device is provided.

In a further embodiment the signal processing device further comprises a controller for controlling the detecting means in order to perform a detection of the characteristic parameter whenever the signal processing device is connected to a programming device and a programming software of that programming device accesses the signal processing device. This facilitates the detection of incorrect receivers if the receiver is changed at the dispenser who carries out the programming of the signal processing device and/or carries out further adaptations of the hearing aid to the needs of the user.

In a preferred embodiment, a characteristics of the receiver is included in or constituted by the identification signal of the electronic ID tag.

In an embodiment, the electronic ID tag is an RFID tag. In a preferred embodiment, the RFID tag is passive. It may, alternatively be active (e.g. powered through a wired connection to the part of the hearing aid comprising the signal processing device).

In an embodiment, a characteristics of the receiver is a characteristic parameter of an additional element included in the receiver, such as a capacitor or a resistor or any other electronic element.

In an embodiment, the electronic ID tag comprises an electronic ID-circuit adapted to provide an electrical output signal comprising a specific ID code in response to a control input signal from the detector, the ID code being indicative of the type of receiver.

In an embodiment, the electronic ID tag comprises an electronic ID-circuit adapted to provide an electrical output signal comprising a specific ID code in response to a control input signal from the detector, the ID code being indicative of a characteristics, e.g. a frequency response, of a particular receiver.

In an embodiment, the electronic ID tag comprises a specific type-ID code being indicative of the type of receiver and/or a specific individual-ID code being indicative of a characteristics, e.g. a frequency response, of a particular receiver.

In an embodiment, the electronic ID circuit comprises non-volatile random access memory (NVRAM).

In an embodiment, the electronic ID circuit comprises a digital integrated circuit.

In an embodiment, the electronic ID circuit is adapted to deliver a unique code in response to the control input signal.

In an embodiment, the electronic ID circuit is adapted to be programmable.

In an embodiment, the electronic ID circuit is adapted to be programmable after the receiver part including the electronic ID circuit has been manufactured.

In an embodiment, a receiver part of the hearing aid comprising the receiver and the electronic ID tag and being connectable to a processing part of the hearing aid comprising the signal processing device via the socket is adapted to receive its energizing power from another part of the hearing aid, e.g. from the processing part.

In an embodiment, the hearing aid comprises a plug and a socket for establishing the electrical connection between the receiver and processing parts.

In an embodiment, the hearing aid is a Receiver-in-the-Ear (RITE) device.

In an embodiment, a characteristics of a receiver comprises a general type description, such as a <receiver type code>, where the <receiver type code> at least identifies the maximum output of the receiver (dB SPL (Sound Pressure Level)) or its sensitivity (dB SPL) at a specified frequency.

In an embodiment, a characteristics of a receiver comprises a unique <serial number> identifying the particular item, thereby allowing a unique identification and traceability of a particular receiver.

In an embodiment, a characteristics of a receiver comprises a precise intended and/or actual frequency response comprising e.g. its sensitivity or maximum output versus frequency at a predefined number of frequencies.

In a further aspect, a method of adapting a hearing aid device to the needs of a hearing impaired user of that hearing aid is provided. The method comprises the following steps:

(a) connecting a receiver of a predetermined type to a signal processing device to which a microphone is connected;
(b) detecting the type of the receiver by the signal processing device;
(c) transmitting information related to the type of the receiver, information about the signal processing device and information about the microphone from the signal processing device to a programming device;
(d) inputting information about the hearing loss of the hearing impaired user into the programming device; and
(d) programming the signal processing device by the programming device based on the information related to the type of the receiver, the information about the signal processing device, the information about the microphone and the information about the hearing loss of the hearing impaired user.

It is intended that the structural features of the hearing aid described above, in the detailed description of 'mode(s) for carrying out the invention' and in the claims can be combined with the method, when appropriately substituted by a corresponding process. Embodiments of the method have the same advantages as the corresponding device.

In an embodiment, the method further comprises the step of:

(e) choosing an appropriate type of receiver to be connected to the signal processing device in step (a) based on the degree of severity of the hearing loss.

In an embodiment, the type of the receiver connected to the signal processing device is detected in step (b) by detecting a characteristic parameter of the receiver.

In an embodiment, the hearing aid device is a hearing aid as described above, in the section on 'mode(s) for carrying out the invention' and in the claims.

In a further aspect, use of a hearing aid as described above, in the detailed description of 'mode(s) for carrying out the invention', and in the claims is provided.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be more easily understood by the persons skilled in the art from the following description of preferred embodiments in connection with the drawings. In the Figures thereof.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODES FOR CARRYING OUT THE INVENTION

Figure 1:
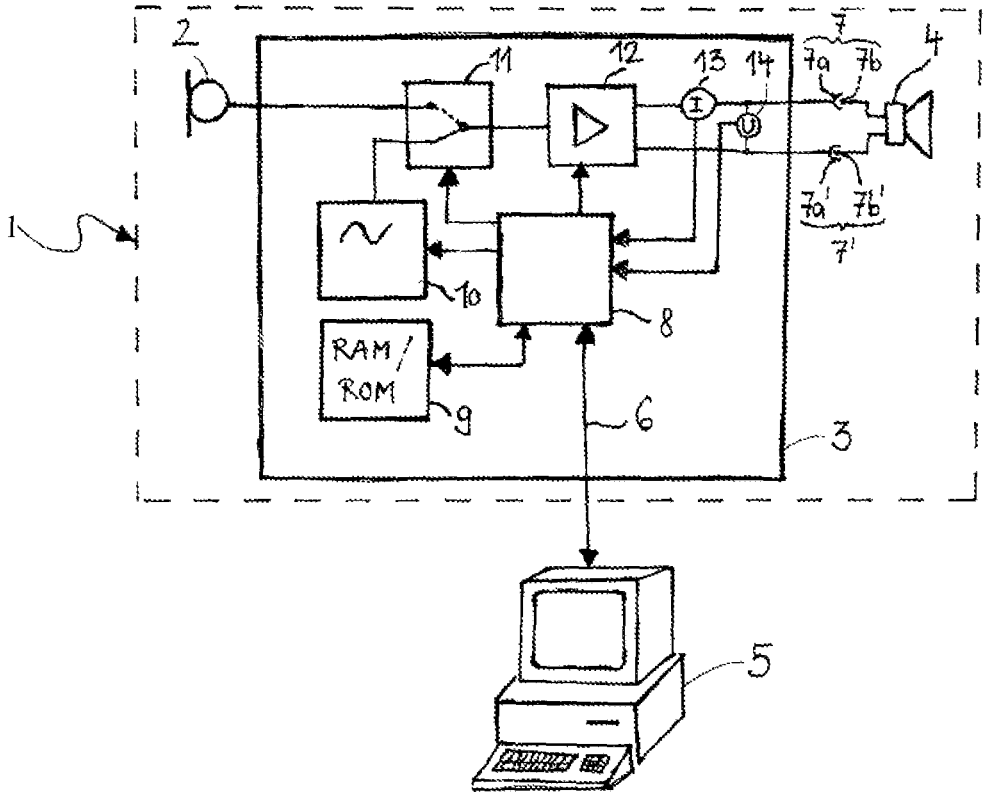
FIG. 1 shows a hearing aid and a programming device according to a first embodiment of the invention.

FIG. 1 shows a hearing aid 1 comprising a microphone 2, a signal processing device 3 and a receiver 4. Programming device 5 is connected to the signal processing device 3 of the hearing aid 1 via a wireless or wired connection 6.

The receiver 4 is connected to the signal processing device 3 by a detachable connector 7, 7'. Receivers of different type, in particular receivers having a different maximum output sound pressure level, are connectable to the signal processing device 3.

The signal processing device 3 comprises a controller 8, a memory 9, a signal generator 10, a switch 11, an amplifier 12, an ammeter 13 and a voltmeter 14 arranged either as discrete devices on a circuit board or integrated in the signal processing device 3. To detachably connect the signal processing device 3 to a receiver 4, it is provided with female connectors 7*a* and 7*a'* which correspond to the male connectors 7*b* and 7*b'* of the receiver 4. Such connector pairs are also known as plug/socket connectors, and naturally the plug- and socket parts as well as the male-female parts are interchangeable and may then be provided on either part of the hearing aid.

A switch 11 connects either microphone 2 or the signal generator 10 to the input of the amplifier 12. A first output of the amplifier 12 is connected to the input terminal of the ammeter 13, the output of which is connected to the first output terminal 7*a* of the signal processing device 3. A second output terminal of the amplifier is connected to a second output terminal 7*a'* of the signal processing device 3. Either the first or the second output terminal of the amplifier 12 may be connected to a reference potential such as the ground potential. The voltmeter 14 is connected between the two output terminals 7*a* and 7*a'* of the signal processing device 3. The controller 8 receives the measurement results of the ammeter 13 and of the voltmeter 14. To be able to process the analog input from the microphone 2 as well as the measurement results of the ammeter 13 and the voltmeter 14, the signal processing device 3 is provided with one or more analog/digital converters (not shown). Furthermore, the controller is connected to a memory 9 and is connectable to the programming device 5. The controller 8 controls the operation of the signal generator 10, of the switch 11 and of the amplifier 12. In particular, the controller 8 controls the degree of amplification, i.e. the amplification factor of the amplifier 12, which can be frequency dependent. Control parameters which determine the control function of the controller 8 are stored in the memory 9. New control parameters can be input into the signal processing device 3 by the programming device 5 through the wireless or wired link 6.

Figure 2:
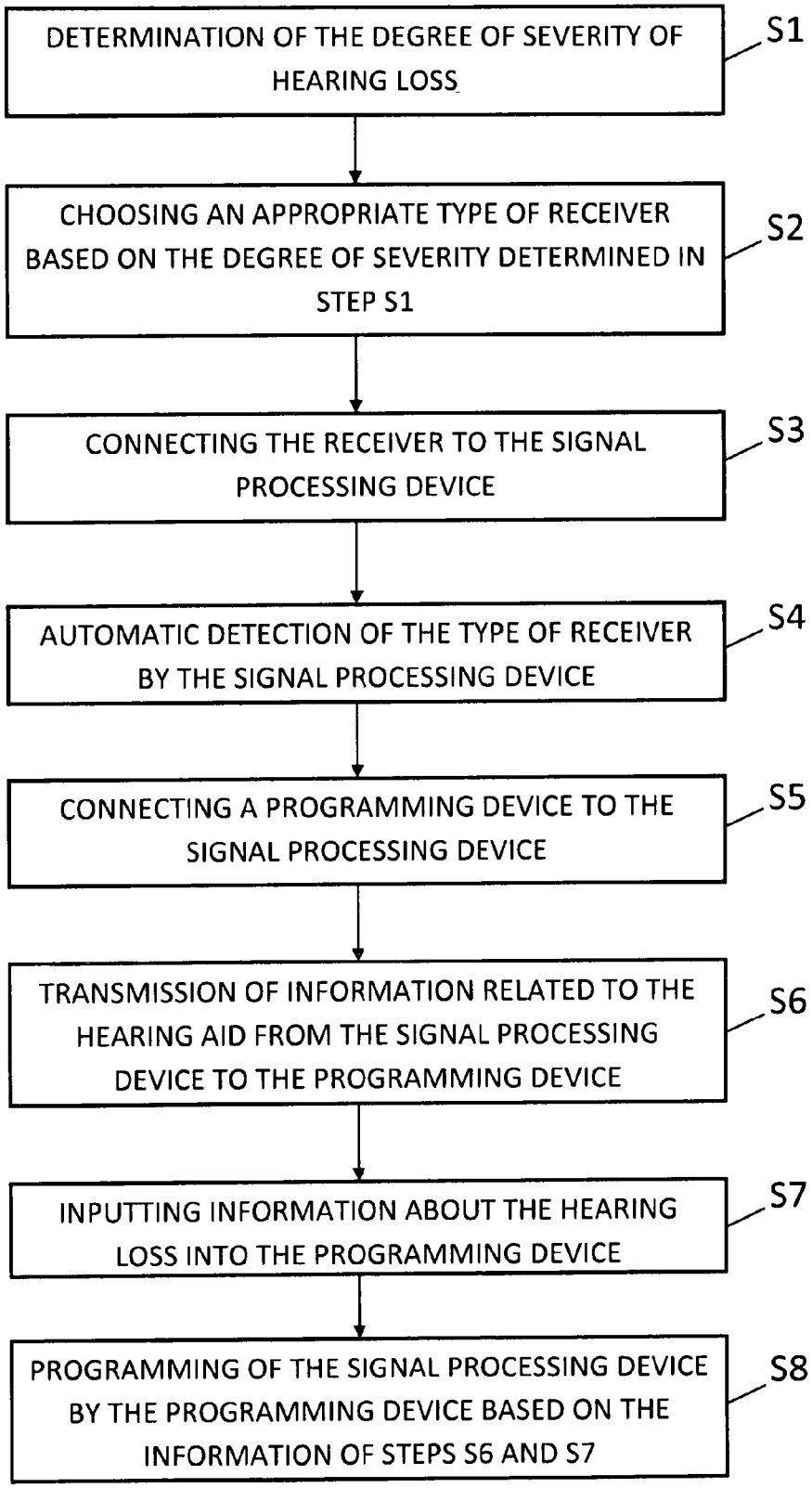
FIG. 2 illustrates the method for adapting a hearing aid to the needs of a hearing impaired user, wherein the hearing aid and the programming device of FIG. 1 is used.

In the following, the adaptation of the hearing aid according to the first embodiment to the needs of a hearing impaired person is described with reference to FIG. 2.

In a first step S1, the level of severity of the hearing loss, which is usually dependent on the frequency, is determined. Based on this level of severity of the hearing loss, a receiver having an appropriate dynamic range or maximum output sound pressure level is determined in a next step S2. This corresponds to choosing one appropriate type of receiver. Then the receiver of the appropriate type is connected to the signal processing device through the connector 7, 7' in a next step S3. When the receiver 4 is connected to the signal processing device 3, then the signal processing device automatically detects the type of the receiver 4 e.g. by detecting the impedance as a characteristic parameter of the receiver 4 (cf. FIG. 1) or by reading the type of receiver from an electronic ID tag (cf. 35 in FIG. 3) in a next step S4. The impedance of the receiver 4 is determined according to the following detection scheme. First, the controller controls the switch 11 to connect the signal generator 10 to the input of the amplifier 12. The signal generator generates an electric signal of a predetermined waveform such as a sine signal. Then the controller calculates the impedance of the receiver 4 from the measurement results of the ammeter 13 and of the voltmeter 14. Based on the calculated impedance of the receiver 4, the controller determines the type of receiver. Alternatively, the type of receiver 24 is read from an electronic ID tag 35 by the controller 28 via connector 36 (cf. FIG. 3).

In a next step S5, a programming device 5 is connected to the signal processing device via a wireless or wired link 6. Through the wireless or wired link 6, the signal processing device 3 transmits information about the hearing aid device 1 to the programming device 5 in a next step S6. In particular, the information about the hearing aid device 1 contains information about the type of receiver 4 connected to the signal processing device 3, information about the type of the signal processing device 3 and information about the microphone 2 of the hearing aid 1. Based on this information and information about the hearing loss of the hearing impaired person, which is input into the programming device 5 by a qualified person in step S7, the programming device calculates control parameters which are then transmitted via the wireless or wired link 6 to the signal processing device 3 to program the signal processing device in step S8. As described above, these control parameters are stored in the memory 9 of the signal processing device 3. Thereby, the adaptation of the hearing aid to the means of the hearing impaired person, i.e. the user of the hearing aid, is completed.

If later, the receiver 4 is exchanged with another receiver of a different type, performing S4 of the above detection scheme enables the signal processing device 3 to automatically detect the type and impedance of the new receiver and to adapt the control parameters for the control of the amplifier 12 in such way that the output characteristics of the hearing aid is maintained as far as possible. In this way the output characteristics with the new receiver 4 is, as far as possible, similar to the output characteristics of the hearing aid with the receiver 4 connected to the signal processing device 3 before the receiver exchange. In any way, the controller 8 of the signal processing device 3 prevents the hearing aid from outputting a higher sound pressure level after exchange of the receiver with a receiver having a higher maximum output sound pressure level. In this way, the automatic detection of the type of the receiver connected to the signal processing device 3 guarantees that the hearing sense of the user is not damaged after exchange of the receiver 4 with a different type of receiver 4.

The automatic detection of the type of the receiver 4 connected to the signal processing device 3 may be performed periodically or during start-up of the signal processing device 3 when the hearing aid 1 is normally muted or at the dispenser each time the programming software of the programming device 5 accesses the signal processing device 3 of the hearing aid 1. It is also possible to combine the above-mentioned activations of the detection scheme.

Figure 3:
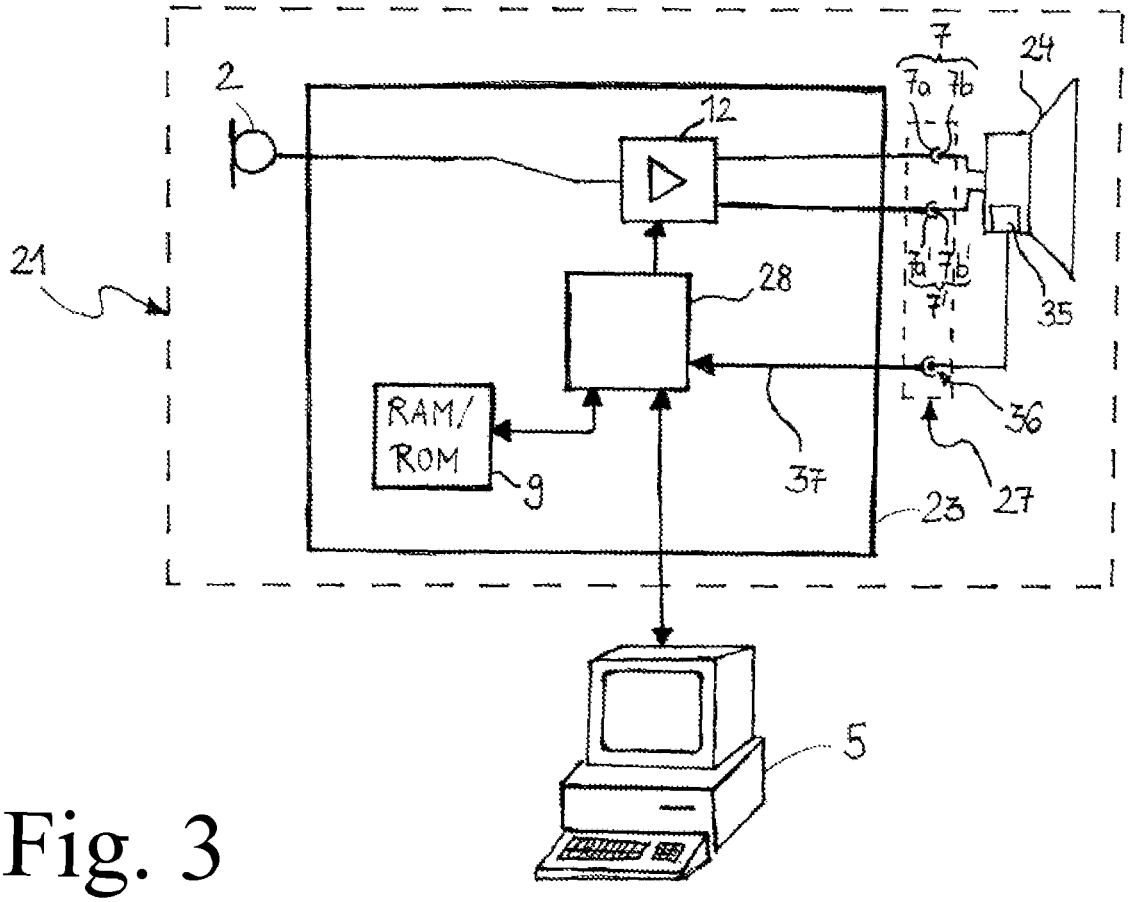
FIG. 3 shows a hearing aid and a programming device according to a second embodiment of the invention.

A second embodiment of the invention is described with FIG. 3. The elements which are the same as in the first embodiment are indicated with the same reference numerals. A repetition of the description of these elements is omitted.

The hearing aid 21 according to the second embodiment of the invention comprises a microphone 2, a signal processing device 23 and a receiver 24. The receiver 24 includes an electronic ID tag 35, wherein the electronic ID tag corresponds to the type of the receiver 24.

The signal processing device 23 comprises an amplifier 12, which is similar to the amplifier 12 of the first embodiment, wherein the input of the amplifier 12 is connected to the microphone 2 and the two output terminals of the amplifier 12 are connected to the output terminals 7*a* and 7*a*' of the signal processing device. The output terminals 7*a* and 7*a*' of the signal processing device 23 are formed as male connectors detachably connectable to a first and a second female connector 7*b* and 7*b*' of the receiver 24, respectively. Further, the signal processing device 23 includes a controller 28 and a memory 9 (including a RAM memory and a ROM memory). The controller 28 is connected to the amplifier 12 and to the memory 9 to control the operation of the amplifier 12 in a similar manner as in the first embodiment. Furthermore, the controller 28 receives, as an input, a signal from the electronic ID tag 35 via a connector 36. The connectors 7, 7' and 36 form a detachable connector 27.

In the second embodiment, the type of the receiver is not detected by detecting the impedance of the receiver but rather by detecting the electronic ID tag via the wired link 37. The operation of the hearing aid according to the second embodiment differs from that of the first embodiment in that the type of the receiver connected to the signal processing device 23 can be detected during normal operation of the hearing aid device 21 (without being connected to the programming device 5).

Figure 4A:
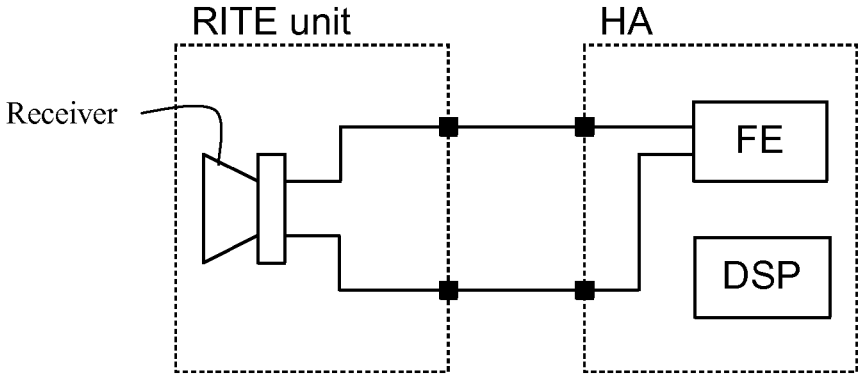
FIG. 4 shows embodiments of a hearing instrument comprising two separate modules, a receiver module (RITE) and a processing module, the two modules being electrically connectable receiver module, a RITE module with only 2 wires between receiver and front end (FIG. 4*a*) and a RITE module with 3 wires between receiver and front end (FIG. 4*b*), the extra wire being a ground wire e.g. to shield against electromagnetic noise.
Figure 4B:
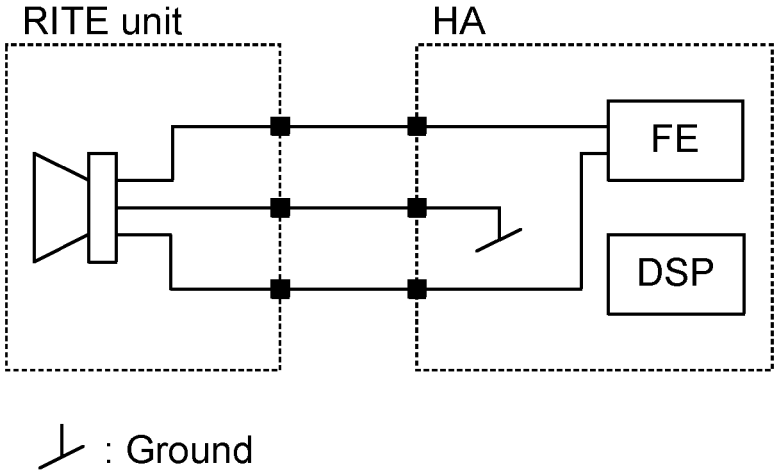

In FIG. 4*a* and FIG. 4*b* simplified electrical diagrams for two prior art hearing aids are illustrated. Each hearing aid comprises (at least) two separate physical units, a RITE unit and a HA-unit (HA), the two parts being electrically connected by electrical conductors and/or by a wireless connection (here a wired connection is indicated), the HA-unit e.g. comprising the rest of the necessary parts of the hearing aid including a processing unit (the remaining parts may optionally be distributed on several separate physical bodies). The embodiment in FIG. 4*a* includes only 2 terminals to connect the HA body and the RITE unit, whereas the embodiment in FIG. 4*b* uses 3 terminals, the third terminal being a ground connection. In both cases, two terminals (connections) are used to connect the receiver of the RITE unit to the front end circuitry (FE) of the HA-unit. A digital signal processor (DSP) is additionally shown in each of the HA-units (to control and perform signal processing).

Today a RITE type hearing instrument (HI) has the receiver attached to the processing part of the HI through a connector. The receiver is connected to a connector, which can be connected to a corresponding connector on the processing part of the HI.

Different types or receivers exist for different HI user fittings (e.g. 'Normal' and 'Power'). But all receivers (of a particular brand) can have the same connector, so that the same processing part of the HI can be used for all RITE fittings.

If all RITE receivers have the same connector, it may be a problem that e.g. a power receiver can be plugged into a normally fitted HI. This may produce a wrong and possibly damaging amplification, because of difference in impedance and frequency characteristics. Further, each receiver has a different frequency response depending on product variations. Knowledge of the exact response of a given receiver can be used by the DSP of the HI to obtain a more precise amplification.

One solution is to have a simple resistor to identify the type of receiver (cf. FIG. 5*a*), but this limits the number of different receivers, which can be detected in practice.

Figure 5A:
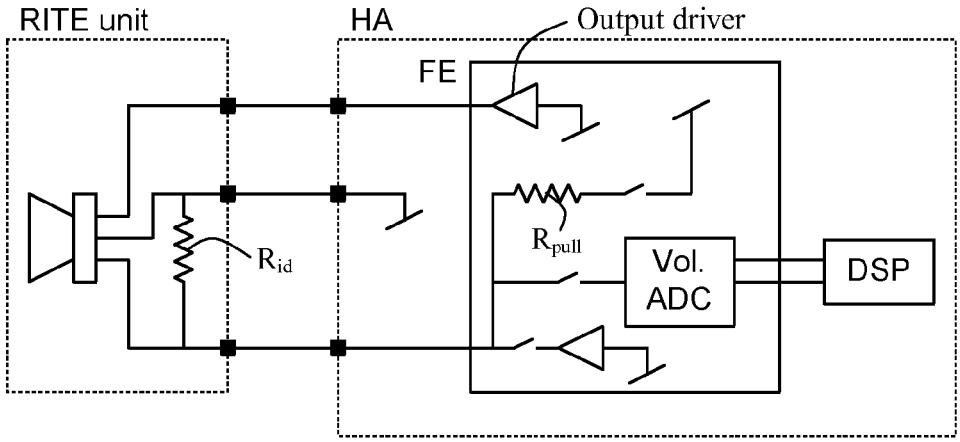
FIG. 5 shows an embodiment of hearing instrument comprising a 2-wire RITE module with 1 extra wire for resistive identification.

As shown in FIG. 5*a*, a resistor ($R_{id}$), located in the receiver (RITE) module, is connected between the ground wire and one of the output drivers of the processing module (when receiver and processing modules are electrically connected). This output driver is tri-stated (high impedance output) and the resistor in the RITE module is pulled high through another resistor ($R_{pull}$), effectively creating a DC voltage between the 2 resistors that can be used for RITE identification. The DC voltage is converted to a digital code using an A/D-converter (Vol. ADC in FIG. 5*a*). Alternatively, FIG. 5*b* shows an embodiment wherein an extra dedicated pin is used to the receiver (resistor) identification.

Figure 5B:
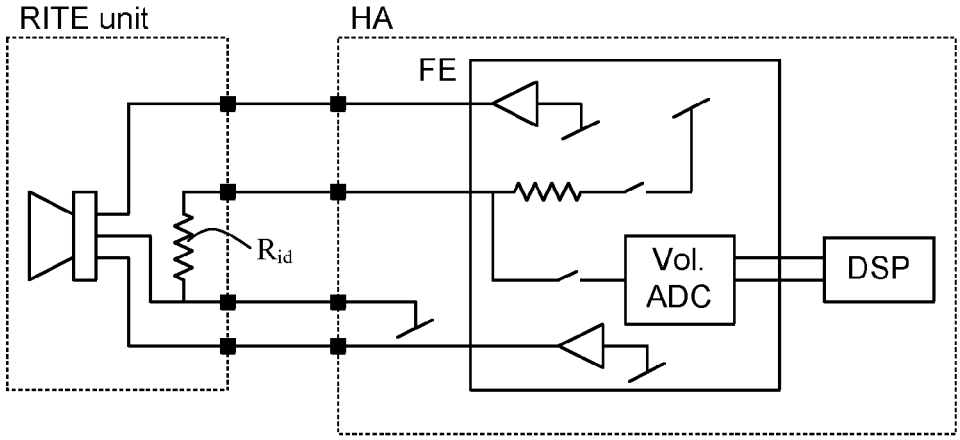
Figure 5C:
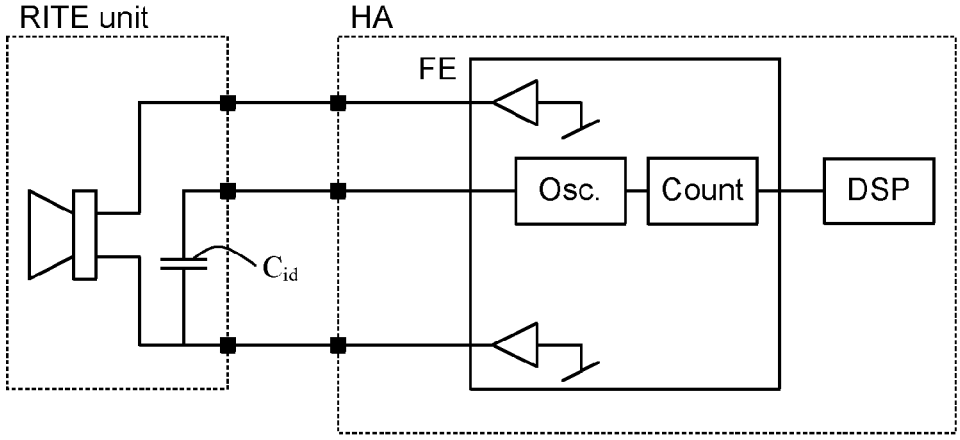

Alternatively, a capacitor ($C_{id}$) can be used as shown in the embodiment in FIG. 5*b*. This requires a different detection scheme. The detection is done by implementing an oscillator in the HA that oscillates with a frequency dependent on the capacitance of the capacitor. Now the RITE identification can simply be performed by counting the number of periods of the signal from the oscillator over a certain period of time.

In the following, examples of embodiments of hearing aids using an electronic ID tag in the form of an RFID circuit (Example 1) and of using a digital integrated circuit (Examples 2-5) are given. The electronic ID tag is e.g. adapted to deliver a unique code in response to a control-input. In an embodiment, where the electronic ID tag is a digital integrated circuit (Dig IC), the Dig IC comprises a type of Non Volatile Memory, e.g. a flash memory. In an embodiment, The Dig IC is adapted to program each bit in production, e.g. based on type and/or measured frequency response, whereby the detected characteristics of the receiver unit by a detector in the processing unit can comprise type information as well as (or) more detailed properties of the specific receiver in question. Furthermore the Dig IC chip may comprise logic to handle the digital interface to the HA unit (cf. Examples 2-5 below).

EXAMPLE 1

Use of RFID in RITE

Figure 6A:
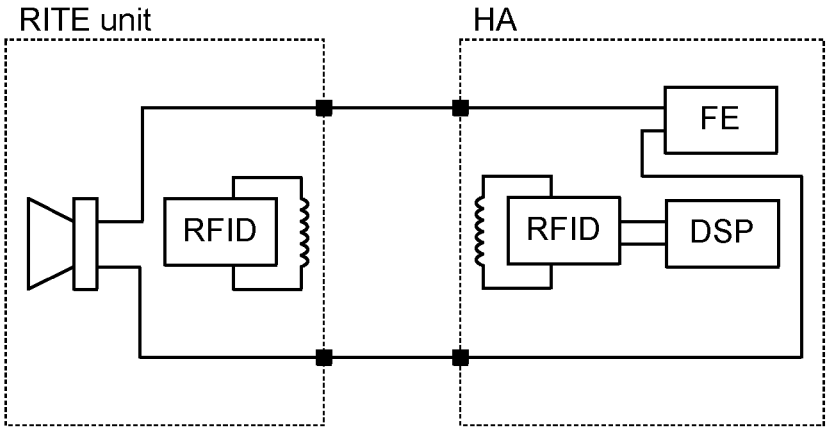
FIG. 6 shows embodiments of a hearing instrument comprising a RITE module with an electronic ID tag comprising a passive RFID tag, FIGS. 6*a* and 6*b* showing 2-wire- and 3-wire solutions with passive RFID-tags, respectively, and FIGS. 6*c* and 6*d* showing 2-wire- and 3-wire solutions with active RFID-tags, respectively.
Figure 6B:
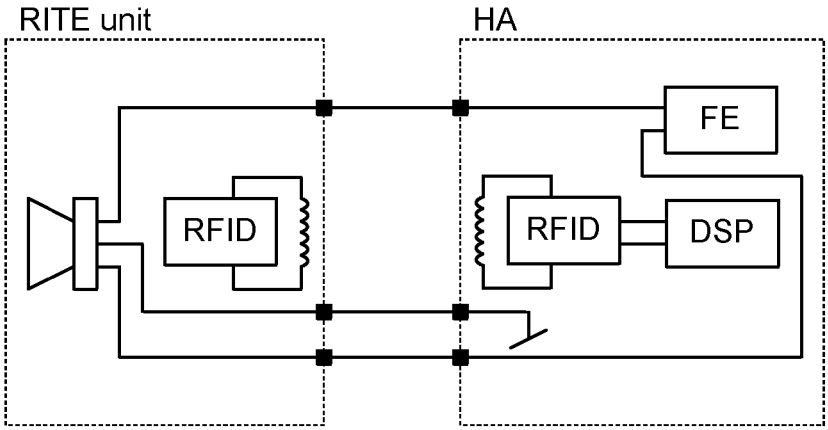

Passive RFID-tag: FIGS. 6*a* and 6*b* shows embodiments of a hearing aid comprising (at least) two separate physical units, a RITE unit and a HA-unit (HA), the two parts being electrically connected by electrical conductors. The embodiments are based on the use of passive RFID tag technology. This technology is widespread and is, e.g., used in security access cards, anti-theft devices on consumer goods, etc. (cf. e.g. Klaus Finkenzeller, RFID Handbook: Fundamentals and Applications in Contactless Smart Cards and Identification 2nd Edition, Wiley, 2003). The technology utilizes an RFID reader (or interrogator) comprising a transmitter—the active part—that in this case must be the HA body (comprising the signal processing device) as illustrated in FIG. 6*a* and FIG. 6*b*. In the RITE module, the passive part (the RFID tag) is located. The transmitter transmits a portion of energy that enables the passive part to wake up and retransmit a unique code, which is received by the active device. The active device is controlled by the HA DSP which, based on the response from the passive device, determines which action to take (e.g. which adaptation of the signal processing is appropriate due to the current receiver ID). The embodiment in FIG. 6*b* differs from that of FIG. 6*a* in that I contains a separate grounding pin of the receiver casing (to improve its noise properties).

Figure 6C:
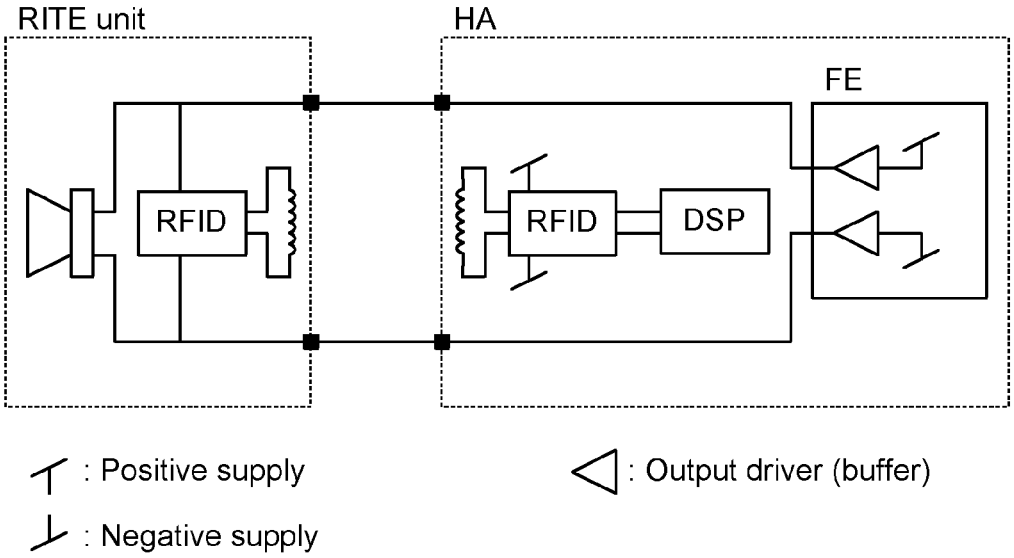
Figure 6D:
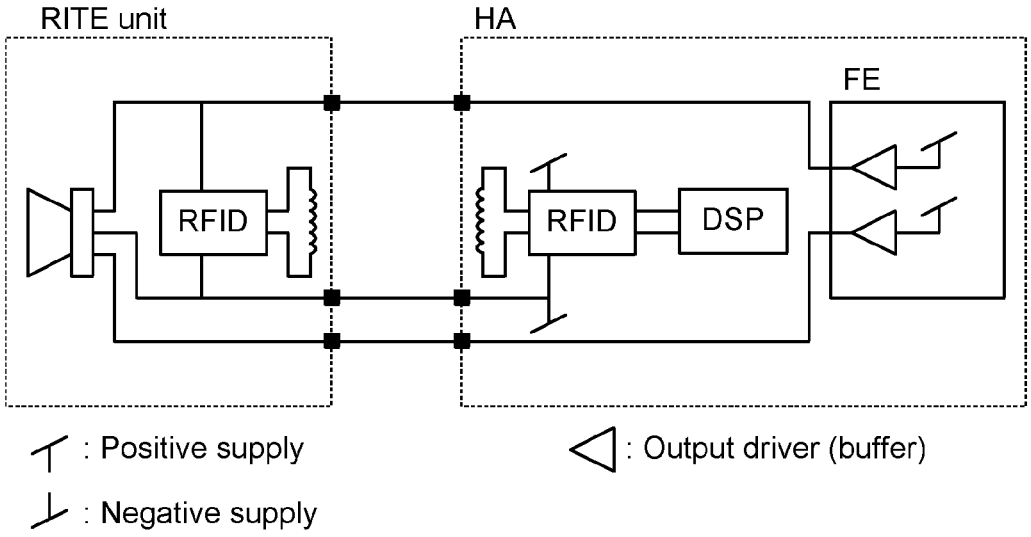

Active RFID-tag: The 'active' embodiments in FIG. 6*c*, 6*d* are similar to the 'passive' embodiments shown in FIG. 6*a*, 6*b* apart from that the RFID IC in the RITE module is powered via the connector to the processing module (HA) using output drivers there (cf. FE in FIG. 6*c*, 6*d*).

EXAMPLE 2

Single wire Digital IC in RITE

The idea is to hook a small digital IC, Dig IC, up between either the 2 drivers or one driver and ground (via the electrical connections to the processing module (HA)). A new connector is used for bi-directional communication, cf. FIG. 7.

Figure 7A:
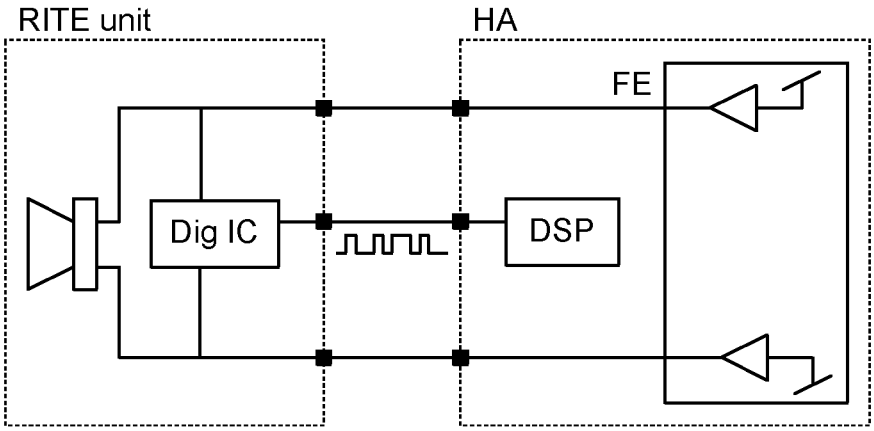
FIG. 7 shows embodiments of a hearing instrument comprising a RITE module with an electronic ID tag comprising a circuit for digital identification, FIGS. 7*a* and 7*b* showing 3-wire and 4-wire solutions, respectively.

FIG. 7*a* shows a 2-wire RITE module with 1 extra wire for digital identification.

Figure 7B:
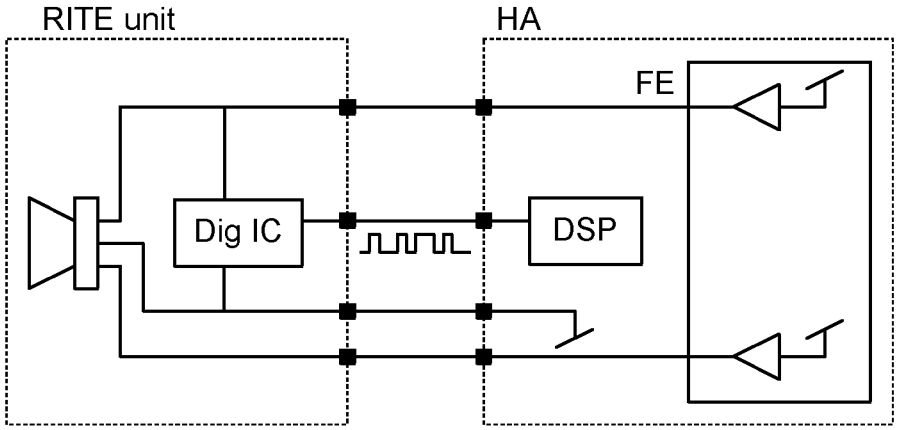

FIG. 7*b* shows a 3-wire RITE module with 1 extra wire for digital identification.

The size of the Dig IC is largely dictated by the number of pin connections required on the IC. In this case 4 pins are required (a programming pin is required but not shown). It will require on-chip oscillator and memory—e.g. NVRAM or electrical fuses—to store the identification code.

The solution will be very robust to interference because a wired digital communication is used.

The complexity of the Dig IC is low.

In FIG. 7*a* the DC impedance through the receiver should preferably be sufficiently high in order not to draw too much current when the RF-IC chip is powered for ID operation. At 1.25 V, a 625 Ohm DC impedance will result in a static 2 mA current through the receiver.

The solution can provide unique identification of the RITE modules (RITE unit in FIG. 7).

EXAMPLE 3

Single Wire Digital IC in RITE

Figure 8A:
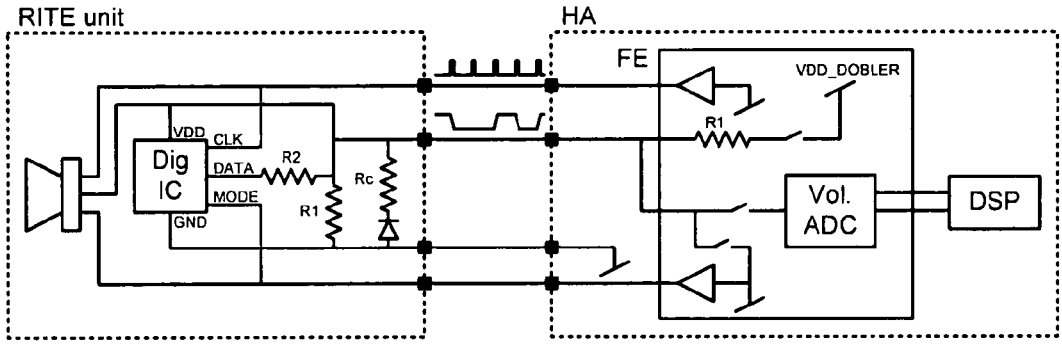
FIG. 8 shows embodiments of a hearing instrument comprising a RITE module with an electronic ID tag comprising a circuit for digital identification, FIGS. 8*a* and 8*b* showing different 4-wire solutions, respectively, FIG. 8*c* illustrating the 'backward compatibility' of the embodiment of FIG. 8*a* (the RITE-module having a resistive ID-element)

FIG. 8*a* shows a 3-wire RITE module with 1 extra wire for digital identification.

This solution uses only one extra pin, which is used as a combined power and signaling wire for the digital IC (Dig IC) in the RITE unit.

The IC can in theory be relatively compact, because the clock is provided by the DSP and no oscillator is needed on the Dig IC. But the minimum of 4 pins required will likely be dominant for the size of the Dig IC.

The idea is to power the digital IC in the RITE unit from the voltage doubler in the FE unit with a voltage split from the two R1 resistors (located in the RITE unit and the HA unit, respectively). The value of R2 is selected such that the level of the combined data and power line never drops more than 10%. When the DATA output is high no voltage drop exists over R2 and the measured value on the ADC is VDDDOUBLER/2. When the DATA output is low, R1 and R2 in the RITE unit is in parallel. Now the measured value on the ADC is $$VDDDOUBLER*((R1\|R2)/((R1\|R2)+R1).$$

As an example take VBAT at 1 V, then VDDDOUBLER is 2 V. If we select R1 at 50 kΩ and R2 at 250Ω, the resulting VDD at the ADC for high and low DATA value is 1.00 V and 0.91 V, respectively. This allows us to measure high and low values with the ADC.

Furthermore this solution can potentially be 'backward compatible' with previous solutions based on a single resistor (cf. FIG. 5*a*, 5*b*). This however requires that the value of R1 and R1||R2 and values above are NEVER used as ID value for a RITE-receiver. The value of R1||RC is then the resistive ID in a HA with a prior art RITE ID based on a single resistor (cf. FIG. 5*b*) as shown in FIG. 8*c*. In this 'backward compatible' version the two pins for GND and ID are reversed (cf. FIG. 8*b*). Also RITE receivers with resistor ID can be detected by the new HA as shown in FIG. 8*c*, as long as the resistive value is not near R1. The detection of R1 would be used to initiate the digital ID sequence.

The Dig IC chip can be powered effectively down, as its power input is driven from a GPIO pin.

The two drivers will have exactly the same (balanced) and small load. They both drive high-impedance control inputs. Care must be taken to design the ESD protection, in order not to increase the load, when the inputs are driven high while the power input is low.

EXAMPLE 4

Double Wire Digital IC in RITE

Figure 9A:
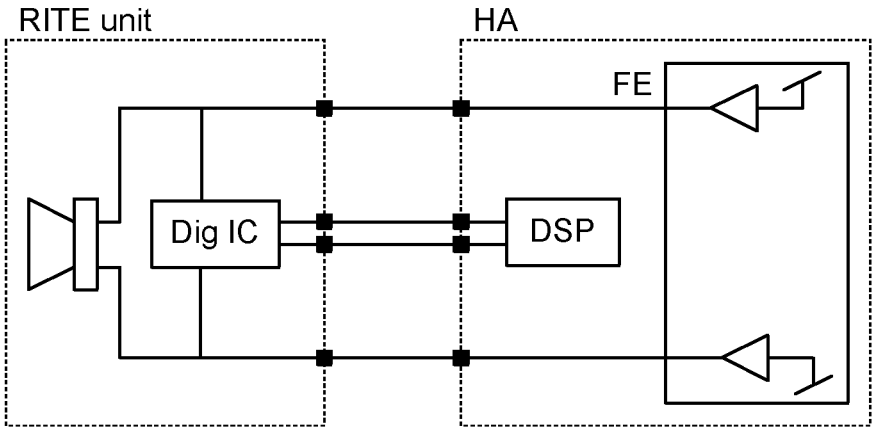
FIG. 9 shows embodiments of a hearing instrument comprising a RITE module with an electronic ID tag comprising a circuit for digital identification, FIGS. 9*a* and 9*b* showing 2-wire- and 3-wire solutions, respectively with 2 extra wires for digital identification.

FIG. 9*a* shows a 2-wire RITE module with 2 extra wires for digital identification.

Figure 9B:
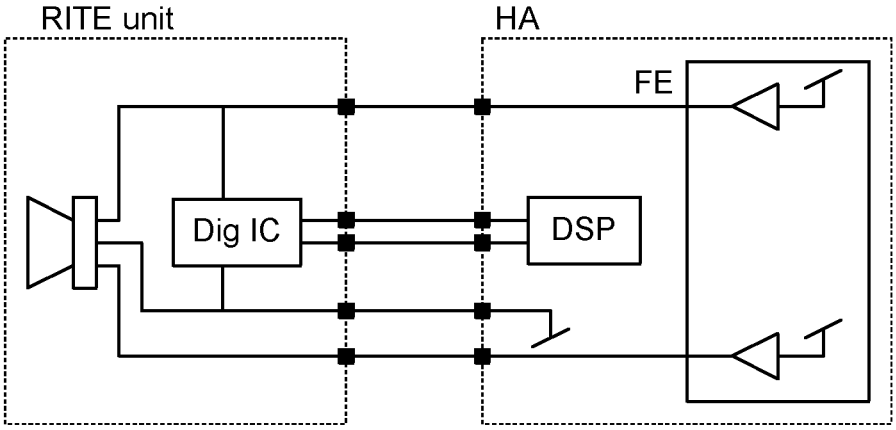

FIG. 9*b* shows a 3-wire RITE module with 2 extra wires for digital identification.

In these embodiments, 2 wires are used for communication between the DSP and the Dig IC.

This solution differs from Example 2 in that the Dig IC can be brought into a mode where it consumes very little current by simply stopping the clock. Effectively, this corresponds to powering down the IC.

EXAMPLE 5

Triple Wire Digital IC Setup

Figure 10:
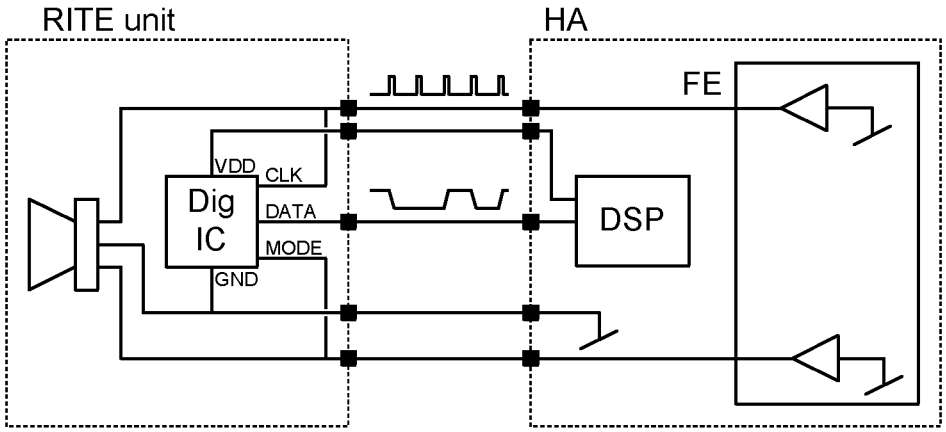
FIG. 10 shows an embodiment of a hearing instrument comprising a 3-wire RITE module with an electronic ID tag comprising a circuit for digital identification, with 2 extra wires for digital identification.

FIG. 10 shows a 3-wire RITE module with 2 extra wires for digital identification.

The Digital IC in the RITE unit is expected to have very small power consumption (less than 20 uA). This allows the power supply to be from a GPIO pin (GPIO=General Purpose Input/Output pin) on the DSP or the FE chip. The benefit thereof is that it is not required to have a special extra power switch capable of delivering more current. One of the driver pins is used as a clock input, the other drive pin as mode input. The extra pin is used as the digital signal back to the DSP to sample information.

Five (5) pins are required on this chip. This will likely dominate the size parameter of the chip. However, the extra pin makes it possible to program as well as read the ID after RITE module production.

In this solution the Dig IC is powered down by use of the GPIO pin controlling the power input. The two driver pins for the receiver will see a slightly increased, but balanced, load.

The drive pins must preferably be controllable as a clock output while the others are static. Simple GPIO control is easy to implement though.

The two drivers will have exactly the same (balanced) and small load. They both drive high-impedance control inputs. Care must be taken to design the ESD protection, in order not to increase the load, when the inputs are driven high while the power input is low.

A common ground connection is required.

EXAMPLE 6

A Hearing Aid Comprising a Frequency Response Measurement

FIG. 11 shows embodiments of a hearing instrument comprising two separate modules, a receiver module (RITE) and a processing module, wherein the processing module comprises means for performing a frequency response measurement of the receiver of the RITE module when the two modules are electrically connected.

Figure 11A:
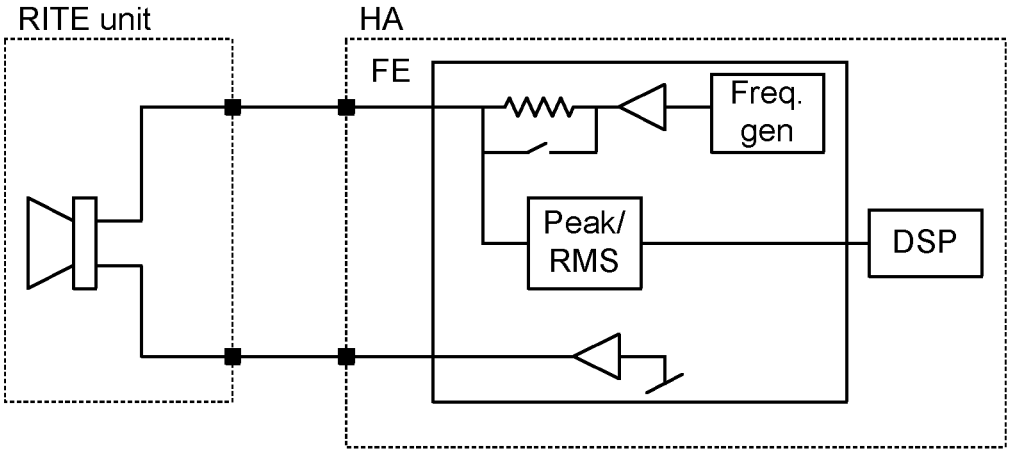
FIG. 11 shows embodiments of a hearing instrument comprising two separate modules, a receiver module (RITE) and a processing module, wherein the processing module comprises means for performing a frequency response measurement of the receiver of the RITE module when the two modules are electrically connected, FIG. 11*a* and 11*b* showing 2-wire- and 3-wire solutions, respectively.
Figure 11B:
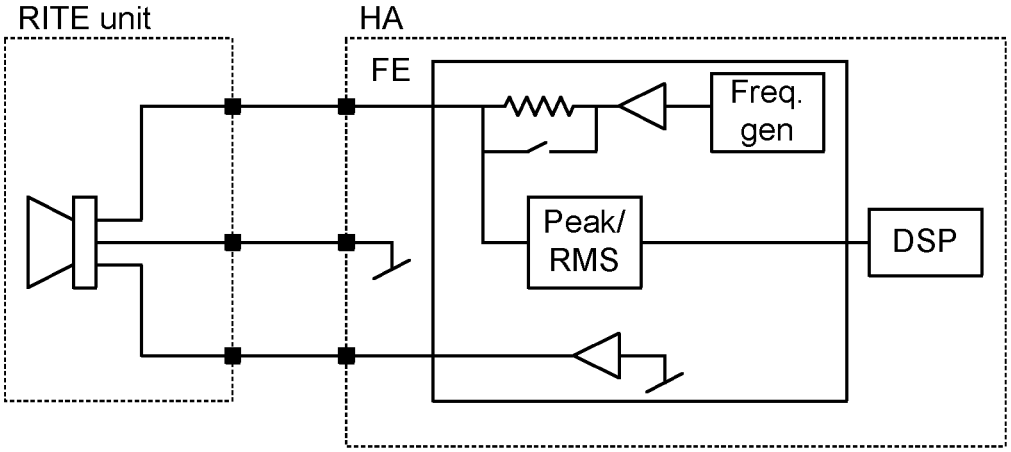

FIG. 11*a* and 11*b* show 2-wire- and 3-wire solutions, respectively.

Based on an input from a frequency generator (Freq. gen. in FIG. 11), one of the output drivers of the front-end block (termed FE in FIG. 11) of the processing module (termed HA in FIG. 11) is used to apply a square wave to the receiver of the receiver module (termed RITE unit in FIG. 11) through a resistor (here located in the front-end-circuit). The level of the signal during the sweep can be controlled by adjusting the duty cycle of the square wave applied to the output drivers. If made in the audible part of the frequency range (e.g. selected from the range between 20 Hz and 20 kHz), the sweep signal may be audible in order to provide sufficient signal power for the measurement. It is therefore advantageous to make such identification or characterization, while the user is not wearing the hearing aid. Alternatively, the sweep could be made outside the audio band. A detection circuit, shown in FIGS. 11*a* and 11*b* as a Peak/RMS detector, measures the frequency response as the frequency of the square wave is sweeped over the audio band. The detection circuit (Peak/RMS in FIG. 11) is here shown separate from the signal processing unit (DSP in FIG. 11), but might in practice form part thereof.

The resolution of the measurement can be adapted to the practical needs for accuracy in the determination of the amplification.

The present embodiment may be combined with any or the embodiments of Examples 1-5 to implement a solution that provides an identification of a receivers' type as well as a characterization of each individual receiver.

The embodiment of FIG. 11*b* differs from the embodiment of FIG. 11*a* in that it comprises an additional connection between the RITE unit and the HA unit connecting the receiver to a stable potential, e.g. ground, to provide additional noise immunity (e.g. to protect a wireless communication interface against the electromagnetic noise from the receiver).

EXAMPLE 7

Electrical Connection Between a Receiver and a Processing Module (Plug-socket)

Figure 12A:
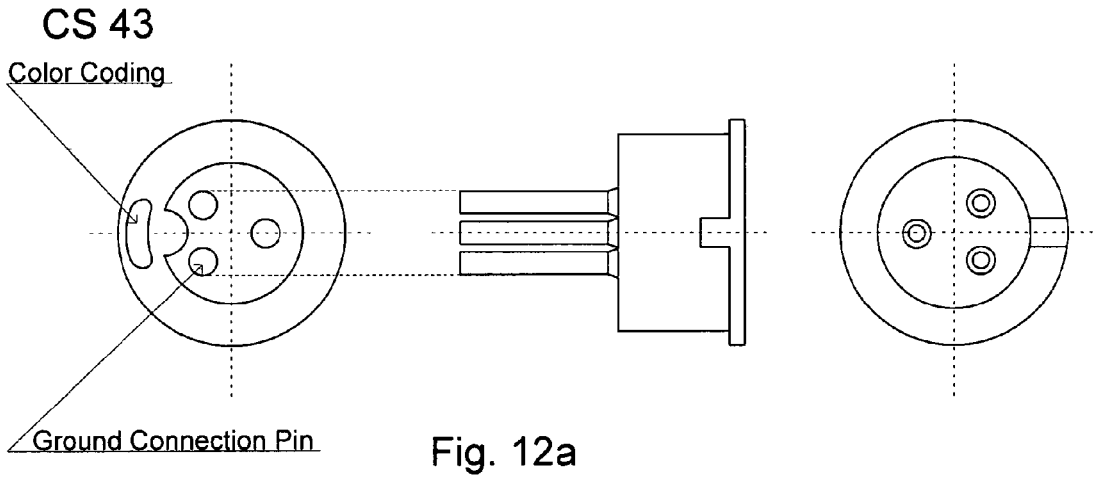
FIG. 12 shows embodiments of a connector with 3 pins (FIG. 11*a*), 4 pins (FIG. 11*b*) and 5 pins (FIG. 11*c*), respectively (from Pulse Engineering Inc.), for use as a connector between a receiver module (RITE) and a processing module of an embodiment of a hearing aid according to the invention.
Figure 12B:
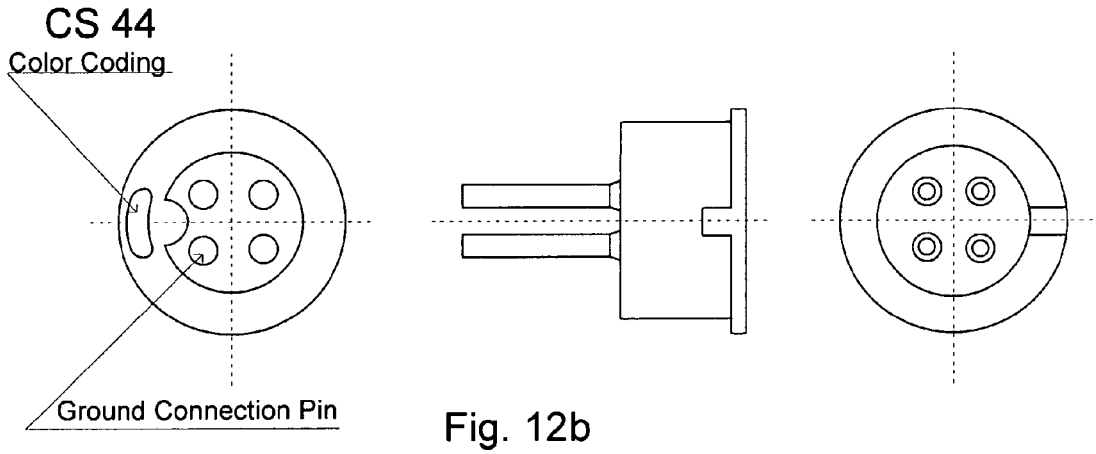
Figure 12C:
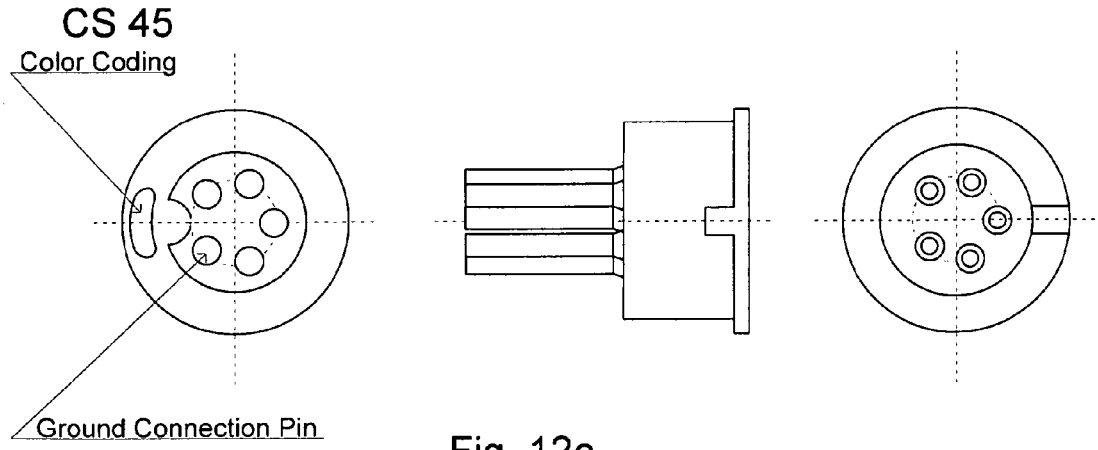

FIG. 12*a*, 12*b*, 12*c* show physical dimensions of the 3, 4 and 5 pin connectors CS43, CS44 and CS45 (plugs and sockets according to IEC-118-12 are e.g. available from Pulse Engineering Inc., e.g. Roskilde, Denmark), which can be used for electrically connecting the receiver and processing modules of the embodiments of a hearing aid according to the invention described in Examples 1-6. The outer dimensions (mm range) are identical for the 3 plugs/sockets. In the embodiments above, ≦5 pins are needed in the RITE connector to implement the ID feature (including the electrical connection between the signal processing unit and the receiver). This is important due to the size constraints of a hearing aid (typically, the more pins the larger the connector, the bulkier the HI). Such connectors can embody connector 27 of the embodiment of a hearing aid as depicted in FIG. 3 and as described above (and likewise connector 7 of FIG. 1).

EXAMPLE 8

A Digital IC for Use as an Electronic ID Tag

Figure 8B:
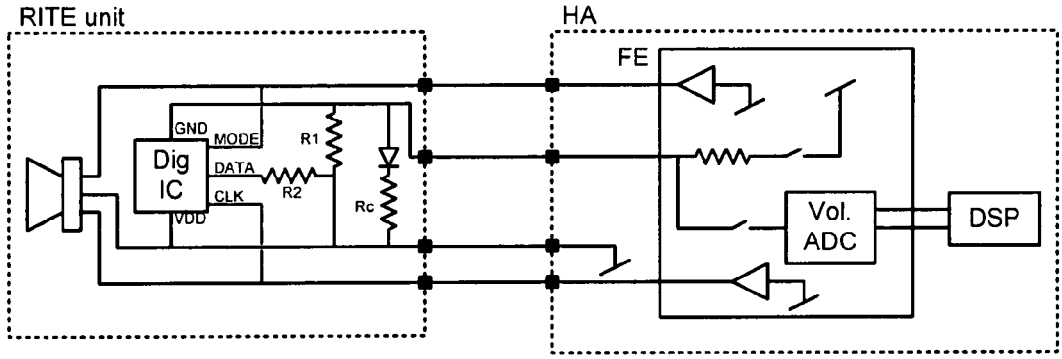
Figure 8C:
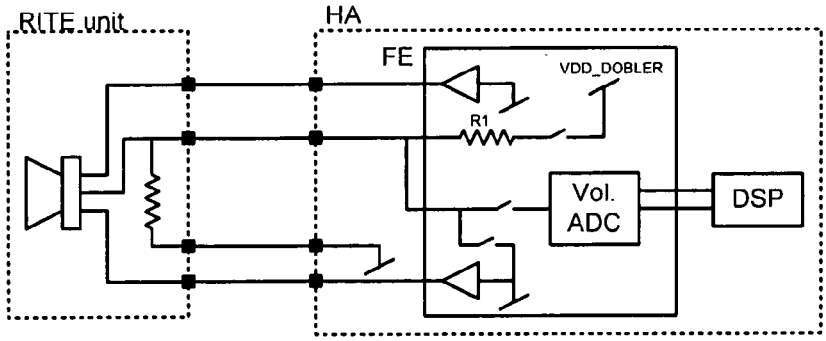

An embodiment of the external connections of a digital IC (Dig IC) is shown in FIG. 8*a*, 8*b*. It has 4 inputs (CLK, MODE, GND, VDD) and 1 output (DATA), cf. also the block diagram in FIG. 13. The clock (CLK) and mode (MODE) inputs are high impedance inputs, including when power supply to the circuit (VDD) is high AND when it is connected to ground (GND). Otherwise, an uncontrollable load may be present on the driver signals to the receiver (the upper and lower electrical connections to the receiver of the RITE unit in FIG. 8*a*, 8*b*), which influences the frequency characteristics of the receiver.

In the embodiment shown in FIG. 8*b*, where the GND input is connected to a higher voltage than the VDD input, it is moreover advantageous that this does not cause a substantial current flow in the IC and that the high impedance of the CLK and MODE inputs is maintained.

Furthermore, the digital IC may include some or all of the resistors and diodes of the RITE unit shown in FIG. 8*a*, 8*b*. This, of course increases the complexity of the IC, but has the advantage of providing a compact and simple mechanical solution facilitating the manufacture of a RITE unit. A further advantage of such integration is that the VDD and DATA inputs merge to 1 external pin. In this case, the digital IC only has four external connections (pins): GND, MODE, CLK, and VDD/DATA.

Figure 13:
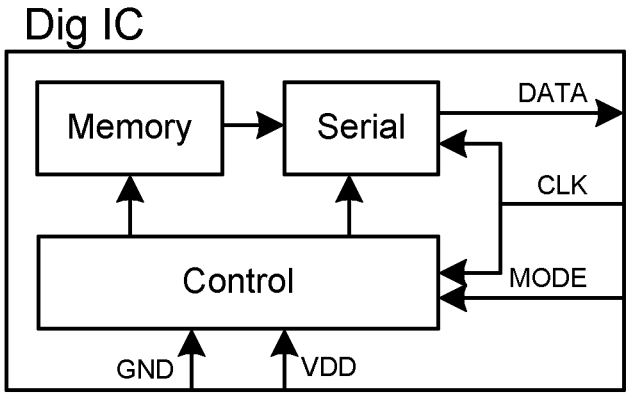
FIG. 13 shows an embodiment of an electronic tag for use in a hearing aid a according to the invention.

FIG. 13 shows an embodiment of an electronic tag for use in a RITE unit according to the invention, here in the form of a digital IC (Dig IC) as described above.

The Dig IC consists of 3 modules: Control, Memory, and Serial. The Control module detects power level on VDD and GND, and uses CLK and MODE inputs to control the operation of the Memory and Serial modules. The Memory module contains the information, which can be transferred from the RITE unit to the hearing aid. The Serial module handles the actual serial transfer of data from the RITE unit to the hearing aid. The Memory module contains memory structure which keeps its value even after the power is disconnected (i.e. a non-volatile memory, e.g. NVRAM).

EXAMPLE 9

Information Stored in an Electronic ID Tag

Some examples of information, which can advantageously be stored in an electronic tag (e.g. a digital IC as described above) and used in a hearing aid according to the present invention are mentioned in the following.

- A general type description, i.e. e.g. <receiver type code>, where the <receiver type code> (e.g. a 4-digit number) at least identifies the maximum output of the receiver (dB SPL (Sound Pressure Level)) or its sensitivity (dB SPL) at a specified frequency (e.g. at 1 kHz).
- A more comprehensive description comprising e.g. <company code>-<receiver type code>-<serial number>, where the <company code> is a manufacturer identification code, the <receiver type code> is as described above, and where a unique <serial number> identifies the particular item. This allows unique identification (and thus traceability) of a particular receiver unit.
- An expected (intended) frequency characteristics (comprising e.g. its sensitivity or maximum output versus frequency, e.g. at a predefined number of frequencies, e.g. at 2 or 5 different frequencies, e.g. at 500 Hz, 1 kHz, 1.5 kHz, 2 kHz, 4 kHz, or at 10 or more frequencies).
- A precise actual frequency characteristics (comprising e.g. its sensitivity or maximum output versus frequency, e.g. at a predefined number of frequencies, e.g. at 2 or 5 different frequencies, e.g. at 500 Hz, 1 kHz, 1.5 kHz, 2 kHz, 4 kHz, or at 10 or more frequencies), e.g. in the form or deviations from an intended frequency characteristics. The precise frequency characteristics can e.g. be measured and stored after production of the receiver unit and/or at the adaptation of the hearing aid to a particular users' needs (i.e. during fitting). This can e.g. be advantageous to increase the traceability of individual items in case of tough (e.g. medical) requirements to the technical specifications. It has the further advantage of allowing a more precise fitting of a particular receiver by utilizing possible deviations from the typical receiver characteristics in the signal processing to provide an improved output stimulus.
- Information about the properties of the plastics construction wherein the receiver is embedded (such construction may influence the frequency characteristics of the RITE-unit when located in the ear).
- Information about the receiver in question being adapted for a left or a right ear of a user. This has the advantage of enabling the hearing aid system itself to differentiate between a left and a right RITE-unit, which in practice can be difficult for a user, if the difference is small (e.g. the direction of turning a connector when assembling the RITE-units to their respective hearing instrument parts). Such left-right differences may alternatively be indicated by the receiver ID and/or serial number.

The use of e.g. a manufacturer ID and a product serial number in ALL receivers (not only in RITE-units but also in BTE and ITE/CIC instruments) would have the advantage of allowing an improved manufacturing traceability.

Modifications from the above described preferred embodiments of the invention are possible. For example, the second embodiment was described with a wired link 37 of the controller 28 to the electronic ID tag 35 with the connector 36. However, it is also possible to provide a wireless link between the controller 28 and the electronic ID tag 35.

The detection of the type of signal processing device was described with the detection of the impedance or an electronic ID tag as a characteristic parameter of the receiver. However, it is also possible to measure other characteristic parameter to detect the type of receiver connected to the signal processing device. For example any characteristic parameter of an additional element included in the receiver could be measured. Such element could be a capacitor or a resistor or any other electronic element.

The embodiments have been described with a digitally programmable hearing aid device. However, the detection of the type of the receiver connected to the signal processing device could be also performed with an analogue hearing aid device, wherein the processing of the sound signals is an analogue processing.

The hearing aid may be any kind of hearing aid comprising at least a microphone, a signal processing device for processing the electronic output signals form the microphone and a receiver for transforming the electrical output signals form the signal processing device back to sound signals. In particular, the hearing aid may be a receiver-in-the-ear (RITE) hearing aid.

The embodiments were described with male and female connectors for connecting the receiver to the signal processing device. However, the receiver could be connected to the signal processing device with any connector providing a detachable connection. It is also possible to use a wireless link to connect the receiver to the signal processing device.

The invention claimed is:

1. A hearing aid, comprising:

a signal processing device;

a connection socket configured to electrically connect and disconnect a receiver to the signal processing device;

the receiver connected to the signal processing device through the connection socket;

a microphone connected to the signal processing device;

a frequency generator configured to output a signal having a selectable frequency; and a detector operable to measure a frequency response of the receiver when the frequency generator supplies the signal having the selectable frequency to the receiver.

2. A hearing aid according to claim 1, wherein the detector is further operable to detect an impedance related parameter of the receiver.

3. A hearing aid according to claim 1, wherein the signal processing device is digitally programmable.

4. A hearing aid according to claim 1, further comprising:

a memory space for storing of the measured frequency response of the receiver, wherein the signal processing device is configured to transfer the stored frequency response from the memory space onto a programming device in response to the programming device being coupled to the signal processing device.

5. A hearing aid according to claim 1, further comprising:

a controller configured to control the detector to perform a measurement of the frequency response of the receiver periodically.

6. A hearing aid according to claim 1, further comprising:

a controller configured to control the detector to perform a measurement of the frequency response of the receiver during the start-up of the signal processing device.

7. A hearing aid according to claim 1, further comprising:

a controller configured to perform a measurement of the frequency response of the receiver in response to a programming software of a programming device connected to the to the hearing aid accessing the signal processing device of the hearing aid.

8. A hearing aid according to claim 1, wherein the frequency response of the receiver comprises actual frequency characteristics comprising maximum output versus frequency at a predefined number of frequencies.

9. The hearing aid according to claim 1, further comprising:

a resistor connected in series between the frequency generator and one terminal of the receiver, wherein the frequency generator is configured to output a square wave signal having the selectable frequency.

10. The hearing aid according to claim 9, wherein the frequency generator is configured to sweep the selectable frequency through a range of frequencies.

11. The hearing aid according to claim 10, wherein the range of frequencies is outside of human audible frequency band.

12. A hearing aid comprising:

a microphone providing audio signals to a signal processing device;

the signal processing device configured to process the audio signals;

a connection socket configured to electrically connect and disconnect a receiver to the signal processing device and convey processed audio signals to the receiver;

the receiver connected to the signal processing device through the connection socket, the receiver including an electronic ID tag;

the electronic ID tag, including an identification circuit configured to recognize a control input signal and to output an identification code in response to the control input signal, the identification code identifying a characteristic of the receiver;

a transmitting circuit configured to provide the control input signal to the electronic ID tag;

a receiving circuit configured to receive a reply signal containing the identification code from the electronic ID tag provided in the receiver; and a detector including a de-coding circuit operable to decode the reply signal received from the ID tag and to obtain the identification code.

13. A hearing aid, comprising:

a microphone providing audio signals to a signal processing device;

the signal processing device configured to process the audio signals;

a connection socket configured to electrically connect and disconnect a receiver to the hearing aid and convey processed audio signals to the receiver;

the receiver connected to the signal processing device through the connection socket;

a capacitor connected to at least one terminal of the receiver, wherein a characteristic parameter of the capacitor identifies a type of the receiver, and the signal processing device is further configured to recognize the type of the receiver based on the characteristic parameter of the capacitor.

14. The hearing aid according to claim 13, further comprising:

a counter operatively connected to the signal processing device and providing a count output to the signal processing device;

an oscillator operatively connected to the counter, the counter configured to count oscillations of the oscillator, wherein the capacitor is connected in series with the oscillator, and the frequency of the oscillations is determined by a capacitance of the capacitor.

15. The hearing aid according to claim 13, further comprising:

a receiver-in-the-ear module housing said receiver and said capacitor, the receiver-in-the-ear module being connectable to a hearing aid module of the hearing aid through the connection socket, wherein the receiver includes two terminals, the two terminals connected to output drivers of the signal processing device while the receiver is connected through the connection socket, and the capacitor is connected to one of said two terminals of the receiver and to a third terminal.

16. The hearing aid according to claim 13, wherein the receiver includes three terminals, two of the three terminals conveying processed audio signals from the signal processing device to the receiver, and the capacitor is connected to one of the two terminals conveying processed audio signals and to a third terminal of the three terminals.

* * * * *